US011031191B2

(12) United States Patent
Pinero et al.

(10) Patent No.: US 11,031,191 B2
(45) Date of Patent: Jun. 8, 2021

(54) CIRCUIT BREAKER LINKING SYSTEM FOR MOVABLE CONTACT

(71) Applicant: SCHNEIDER ELECTRIC INDUSTRIES SAS, Rueil-Malmaison (FR)

(72) Inventors: Eric Pinero, Seyssinet (FR); Brice Jacolin, Vinay (FR); Anais Toumi, Echirolles (FR); Daniel Reviron, Echirolles (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 16/706,924

(22) Filed: Dec. 9, 2019

(65) Prior Publication Data

US 2020/0194193 A1 Jun. 18, 2020

(30) Foreign Application Priority Data

Dec. 14, 2018 (FR) ..... 18 72958

(51) Int. Cl.
*H01H 3/32* (2006.01)
*H01H 3/04* (2006.01)

(52) U.S. Cl.
CPC ..... *H01H 3/32* (2013.01); *H01H 3/04* (2013.01); *H01H 2235/01* (2013.01)

(58) Field of Classification Search
CPC ..... H01H 3/32; H01H 3/46; H01H 33/42; H01H 3/54; H01H 2009/0088;
(Continued)

(56) References Cited

U.S. PATENT DOCUMENTS 4,409,449 A * 10/1983 Takano ..... H01H 3/30 200/400
6,157,275 A 12/2000 Gula
2018/0151320 A1 5/2018 Sun et al.

FOREIGN PATENT DOCUMENTS

CN 204375676 U 6/2015
EP 3 153 722 A1 4/2017
EP 3 291 276 A1 3/2018

OTHER PUBLICATIONS

French Preliminary Search Report dated Sep. 27, 2019 in French Application 18 72958 filed Dec. 14, 2018 (with English Translation of Categories of Cited Documents & Written Opinion), 9 pages.

* cited by examiner

*Primary Examiner* — Vanessa Girardi
(74) *Attorney, Agent, or Firm* — Oblon, McClelland, Maier & Neustadt, L.L.P.

(57) ABSTRACT

A device for switching an electric current with separable electrical contacts includes a switching mechanism including: a switching shaft that is coupled to a mobile electrical contact; a trip hook that is pivotably mounted on a fixed support of the mechanism; a linking system coupling the switching shaft to the trip hook. The linking system includes a first pair of connecting rods that are pivotably mounted on the trip hook and a second pair of connecting rods that are mounted so as to pivot with a crank of the switching shaft. The first connecting rods are connected to the second connecting rods with a single axis of articulation which forms a pivot link between the first connecting rods and the second connecting rods.

13 Claims, 4 Drawing Sheets

Figure 1:
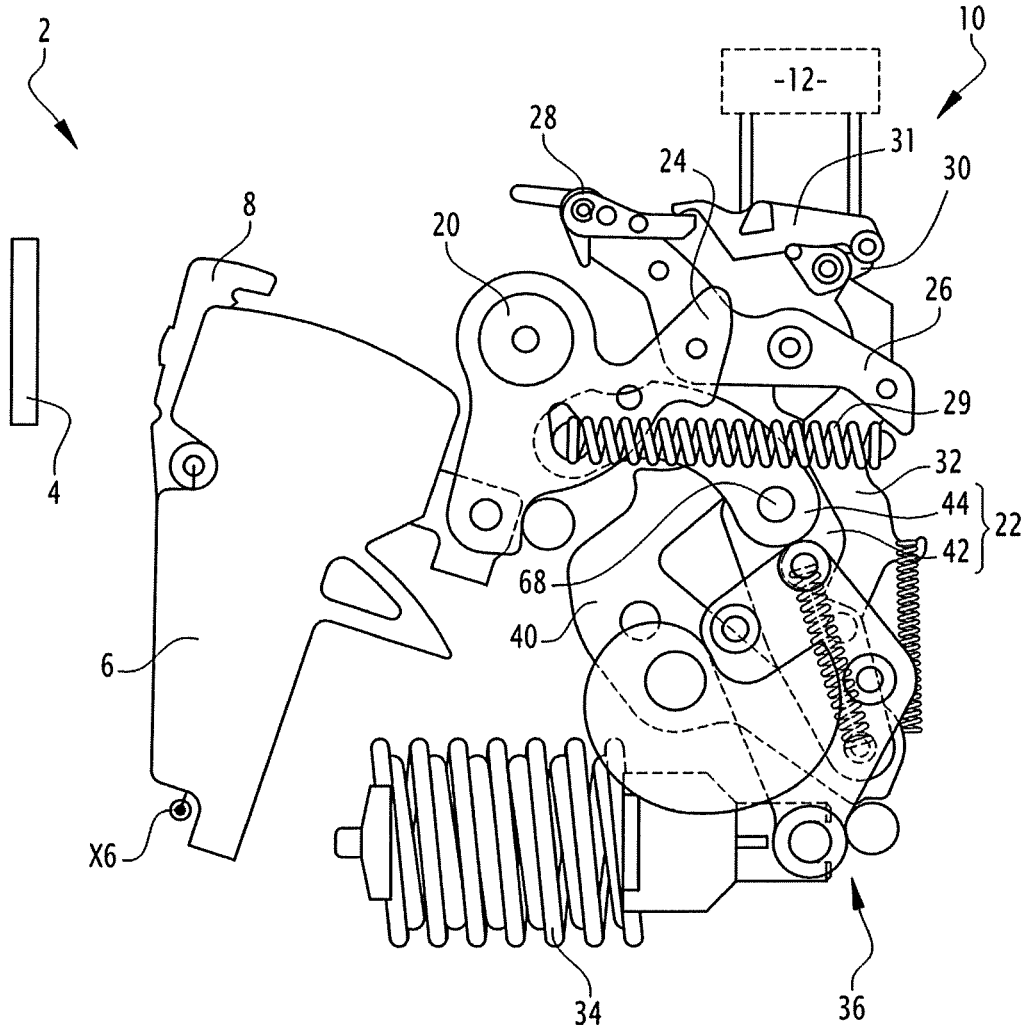

(58) Field of Classification Search
CPC .. H01H 2009/0094; H01H 9/24; H01H 23/16;
H01H 23/162
See application file for complete search history.

CIRCUIT BREAKER LINKING SYSTEM FOR MOVABLE CONTACT

The present invention relates to a device for switching an electric current.

The invention relates in particular to the field of electrical switching devices intended to interrupt an electric current, such as circuit breakers or switches.

Switching devices with separable contacts include a switching mechanism using the accumulation of energy, the function of which is to move the electrical contacts of the device between an open state and a closed state, for example in response to an action by a tripping device or a user.

An example of such a mechanism is described in FR-2 985 600-B1.

By way of example, a pivoting mobile electrical contact is moved by a switching shaft mechanically coupled to a trip hook by means of a linking system. To close the contacts, an energy accumulator comprising a spring is actuated in order to move the linking system.

The switching mechanism is therefore the subject of many mechanical stresses on each opening and closing of the contacts.

Such mechanisms have been satisfactory for a long time. However, in some contemporary applications, it is desirable to be able to have switching mechanisms with improved durability, for example in order to increase the number of opening and closing cycles that are admissible over the life of the product.

There is therefore a need for a device for switching an electric current in which the switching mechanism has improved reliability.

To this end, one aspect of the invention relates to a device for switching an electric current that includes separable fixed and mobile electrical contacts and a mechanism capable of switching the contacts between a closed state and an open state, the mechanism including:

a switching shaft that is coupled to a mobile electrical contact;

a trip hook that is pivotably mounted on a fixed support of the mechanism;

a linking system coupling the switching shaft to the trip hook.

The linking system includes a first pair of connecting rods and a second pair of connecting rods, the first connecting rods being pivotably mounted on the trip hook, the second connecting rods being mounted so as to pivot with a crank of the switching shaft, the first connecting rods being connected to the second connecting rods by means of a single axis of articulation which forms a pivot link between the first connecting rods and the second connecting rods. The axis of articulation combines both the function of ensuring the pivot link and maintaining the spacing of the pairs of rods.

Thus, the reliability of the switching mechanism is increased, in particular by virtue of better durability of the linking system. In particular, the risk of accidental breakage of the pivot link between the first connecting rods and the second connecting rods is reduced by virtue of the use of the linking axis.

According to some advantageous but non-mandatory aspects, such a device can incorporate one or more of the following features, either alone or in any technically permissible combination:

Each of the ends of the axis of articulation includes a head, each head including an overwidth forming a retaining portion for preventing separation of the first connecting rods and second connecting rods from one another.

The axis of articulation includes a peripheral groove formed at the base of each head.

The depth of the peripheral groove is between 0.2 mm and 0.6 mm and, preferably, equal to 0.4 mm.

The height of each head is less than or equal to 5 mm, preferably between 2 mm and 3 mm.

The greatest width of the head is between 9 mm and 10 mm, preferably between 9.6 mm and 9.8 mm.

The axis of articulation is mounted in a linking system so as to have a radial play of less than or equal to 0.1 mm for the first and second connecting rods.

Each of the first connecting rods is mounted on a first area of the axis of articulation having a first diameter, and each of the second connecting rods is mounted on a second area of the axis of articulation having a second diameter, which is different from the first diameter.

The axis of articulation is made of a steel alloy, for example a steel alloy with chromium and molybdenum.

The axis of articulation is formed by a one-piece part.

Each of the second connecting rods has a shape bent in an arc.

Figure 2:
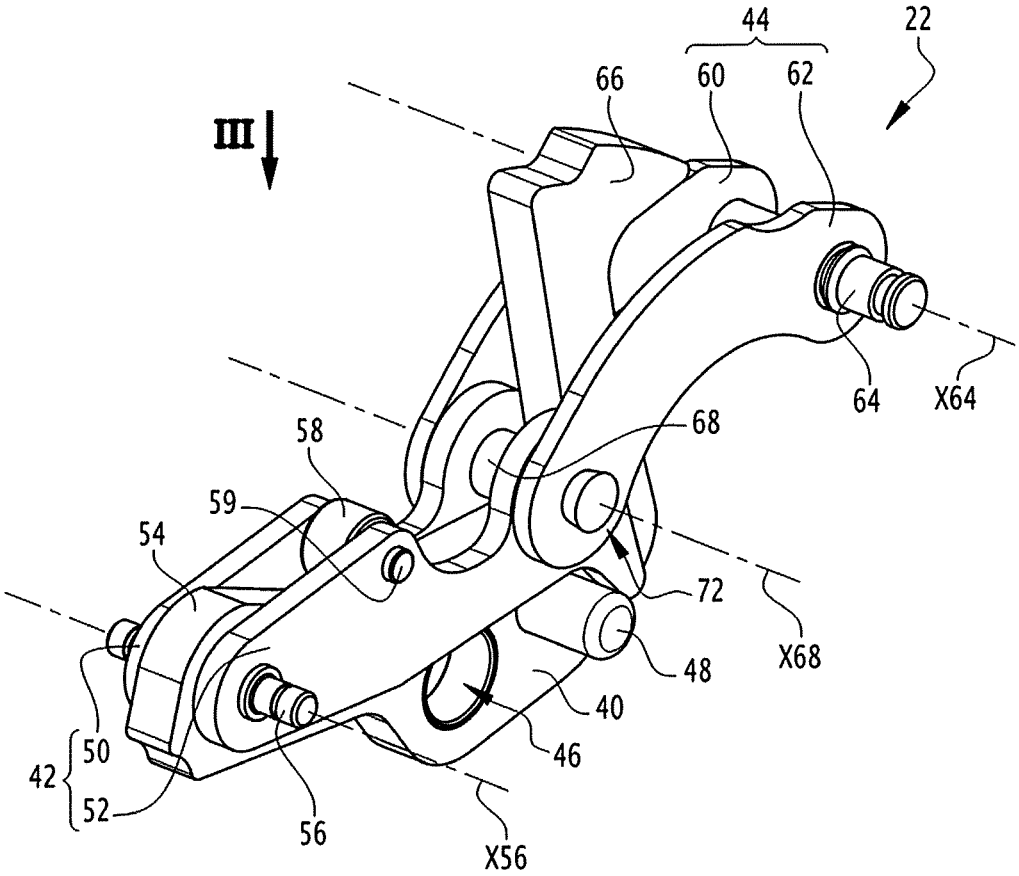
Figure 3:
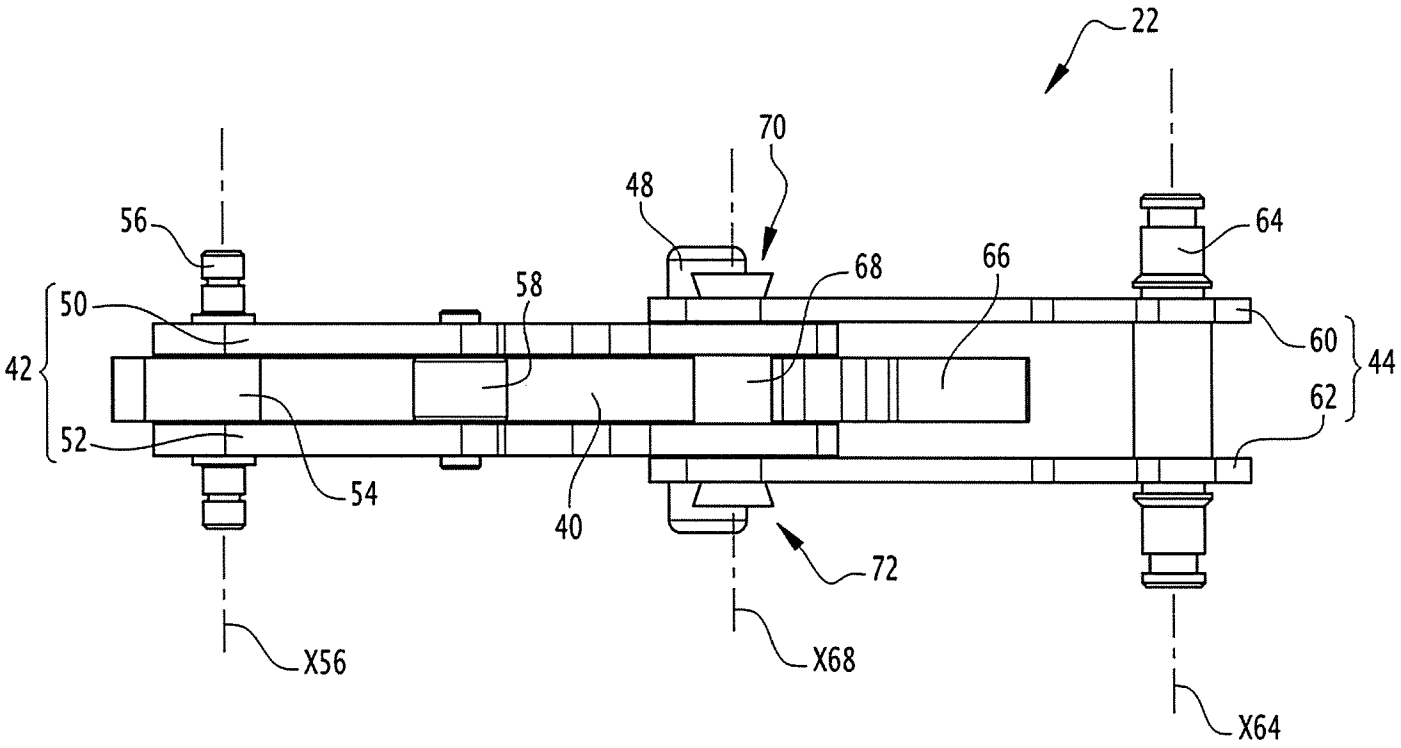
Figure 4:
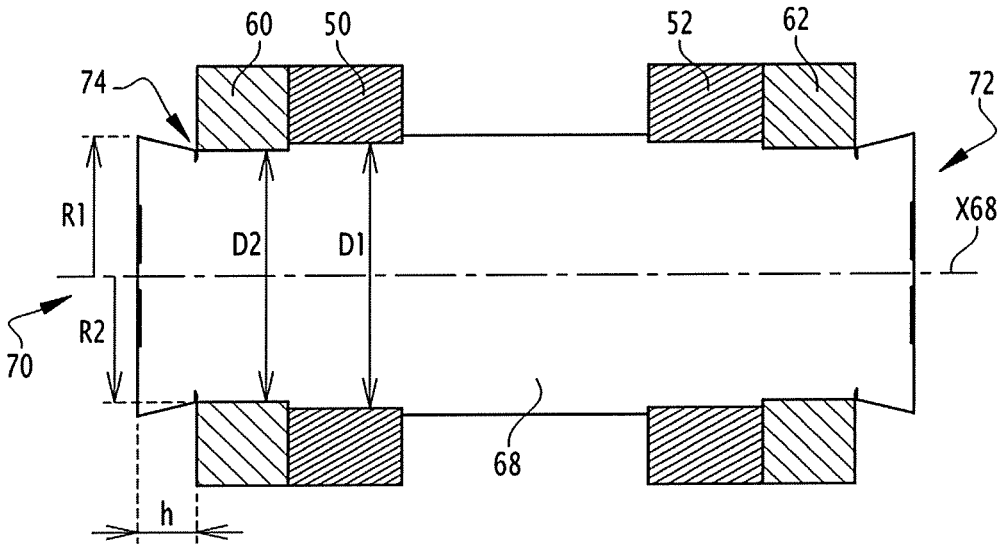

The invention will be better understood and other advantages thereof will become more clearly apparent in the light of the following description of one embodiment of an electrical device provided solely by way of example and with reference to the appended drawings, in which:

FIG. 1 schematically illustrates a switching device with separable contacts, which is shown in a middle sectional plane, including a switching mechanism according to some embodiments of the invention;

FIG. 2 schematically illustrates a linking system forming part of the switching mechanism of FIG. 1, in an isometric perspective view;

FIG. 3 schematically illustrates the linking system of FIG. 2 in a side view represented by the arrow Ill:

FIG. 4 schematically illustrates an axis of the linking system of FIG. 2 in a longitudinal sectional view.

FIG. 1 shows part of an electrical switching device 2 for interrupting an electric current, such as a circuit breaker or a contactor. The electric current is switched in air and by means of separable electrical contacts.

According to some examples, the device 2 is a low-voltage, high-intensity multipole circuit breaker.

The device 2 includes a fixed electrical contact 4 and a mobile electrical contact 6 that, in some examples, bears pivotably mounted contact fingers 8 arranged opposite the fixed contact 4. The contacts 4 and 6 are connected to opposite electrical connecting terminals of the device 2.

The mobile contact 6 is reversibly movable, for example by pivoting with respect to a fixed frame of the device 2, between an open position and a closed position of the contacts, corresponding to an electrically open state and an electrically closed state, respectively, of the device 2. The axis of rotation of the mobile contact 6 is denoted by the reference X6 in the present case.

The device 2 also includes a switching mechanism 10 adapted to switch the contacts 4 and 6 between the open and closed states by moving the mobile contact 6 between the open and closed positions.

For example, the mechanism 10 is controllable by means of a tripping device 12 of the device 2 and/or by a manual control element, such as a lever or a push button.

According to some embodiments, the device 2 is a multipole device adapted to interrupt a polyphase electric current. The device 2 then includes multiple poles, each of which is associated with one electrical phase and includes a pair of contacts 4 and 6. As a variant, the device 2 is single-pole.

According to some implementations, the mechanism 10 is a switching mechanism using mechanical energy accumulation. The operating principle of a switching mechanism using this technology is described in FR-2 985 600-B1, for example.

The mechanism 10 in particular includes a switching shaft 20 coupled to the mobile contact 6, in the present case by means of a pivot link. The shaft 20 is rotatably mobile about its longitudinal axis in relation to a fixed frame, or fixed support, of the device 2.

If the device 2 includes multiple poles, the shaft 20 is common to all of these poles and is mechanically coupled to each mobile contact 6.

The mechanism 10 also comprises a trip hook 40 and a linking system 22 coupling the switching shaft to the trip hook. For example, the linking system 22 is articulated by a pivot link to a crank arm 24 borne by the shaft 20, as described hereinafter.

The mechanism 10 also includes an opening pawl 26 associated with a bolt 28, also called "half-moon".

The opening pawl 26 is mounted so as to pivot in relation to the frame and cooperates with the trip hook 40. A spring 29 is engaged between, firstly, the shaft 20 and, secondly, an axis integral with the frame of the device 2.

A closing bolt 30, also called "half-moon", and an intermediate lever 31 mechanically cooperate with an actuator controlled by the tripping device 12, such as an electromagnetic actuator having a coil, and/or with the manual control element. In FIG. 1, the association between the tripping device and the lever 31 is schematically depicted by rods, although in practice this mechanical cooperation can be produced in quite a different manner.

The bolt 30 is also mechanically associated with a closing pawl 32, mounted so as to pivot in relation to the frame.

The mechanism 10 moreover includes a mechanical energy accumulation device 34, including at least one spring. For example, the device 34 stores mechanical energy when the spring is compressed and releases this mechanical energy through the relaxation of the spring.

A drive mechanism 36, in the present case including one or more linking parts articulated and/or mounted so as to pivot in relation to the fixed frame, is mechanically coupled to the device 34. The drive mechanism 36 acts on the linking system 22 in order to strike it and drive it towards a closed position. This way, by moving, the linking system 22 in turn drives the trip hook 40.

In the present case, the trip hook 40 is mounted so as to pivot in relation to the frame and is articulated to the linking system 22 by a pivot link.

To make it easier to understand the present description, the other components of the device 2 are neither illustrated nor described in detail.

In the embodiments illustrated, the pivot and rotational movements of the elements of the mechanism 10 take place about axes of rotation that are fixed in relation to the frame and that extend parallel to one another, in the present case in directions perpendicular to the plane of the image in FIG. 1 and parallel to the axis X6.

Examples of operation of the mechanism 10 will now be described briefly.

In a stable open position, illustrated by FIG. 1, the device 34 is armed, that is to say that the spring is compressed and stores energy. The bolt 30 keeps the closing pawl 32 in a first position.

To close the contacts 4 and 6, the closing bolt 30 is tilted, for example by the action of the tripping device 12 or of the push button, which releases the closing pawl 32.

The movement of the closing pawl 32 actuates the device 34 and the energy accumulated in the device 34 is released, by a relaxation movement of the spring, and this, by means of the drive mechanism 36, actuates the linking system 22, for example by striking it, so as to move the mobile contact 6 by means of the shaft 20, until the mobile contact 6 comes into contact with the fixed contact 4.

The linking system 22 continues to move towards its closed position until it passes a predefined position of alignment, called "dead centre", in the forward direction, driving the trip hook 40 and the opening pawl 26 towards a stop position in which the linking system 22 is prevented from returning backwards.

The mechanism 10 is then in a stable closed position.

To reopen the device 2, the locking between the opening pawl 26 and the bolt 28 is broken, for example by moving the lever 31 by means of the actuator 12 or by means of a manual action directly on the bolt 28. The opening pawl 26 pivots, which releases the stop of the trip hook 40.

The linking system 22 is then no longer kept in abutment by the hook 40 and can return to its initial position under the action of the restoring force exerted by the spring 29. Once the linking system 22 has returned behind the dead centre position, the contact 6 is driven towards its open position. The mechanism 10 is returned to the stable open position.

FIG. 2 and FIG. 3 show examples of the linking system 22 that are compliant with some embodiments of the invention.

The linking system 22 includes a first pair of connecting rods 42 and a second pair of connecting rods 44 articulated to one another, on which are formed the pivot links for articulation to the trip hook 40 and the shaft 20.

In the example illustrated, the trip hook 40 also bears an aperture 46 that is used to receive a pivot link to the frame and a stop 48, which in the present case projects on either side of the trip hook 40. For example, the trip hook 40 has an essentially flat shape.

According to some examples, in the closed position of the mechanism 10, described above, the stop 48 blocks the first pair of connecting rods 42 so as to block the position of the linking system 22. During the opening movement, the stop 48 forces the first pair of connecting rods 42 to separate under the action of the spring 29, so as to return the linking system 22 towards the open position.

The first pair 42 of connecting rods includes two similar or identical connecting rods 50 and 52 arranged parallel opposite one another. According to some examples, the connecting rods 50 and 52 have a planar shape.

A first end, in the present case a lower end, of each of the connecting rods 50 and 52 is pivotably mounted on the trip hook 40, and more specifically on a distal end 54 of the trip hook 40.

This pivot link, in the present case, is formed by means of a rigid axis 56, such as a journal, which extends perpendicularly to the connecting rods 50 and 52. The reference X56 denotes the axis of rotation associated with this pivot link. The axis X56 is parallel to the axis X6 in the present case.

According to some examples, the linking system 22 can also include a ring 58 mounted between the connecting rods 50 and 52 on a spacer 59 that secures the connecting rods 50 and 52 to one another. The spacer 59 extends parallel to the axis X56 in the present case.

For example, the spacer 59 and the ring 58 are struck by the drive mechanism 36 when the energy is released by the device 34.

In the example of the mechanism 10 that is described above, the dead centre position of the linking system 22 corresponds to the position of alignment of the pairs of connecting rods 42 and 44 among one another along one and the same straight line, the pairs of connecting rods 42 being bent by comparison with the pairs of connecting rods 44 in the other positions.

The second pair 44 of connecting rods includes two similar or identical connecting rods 60 and 62 arranged parallel opposite one another. According to some examples, the connecting rods 60 and 62 have a planar shape.

According to some optional but nevertheless advantageous embodiments, each of the second connecting rods 60 and 62 has a shape bent in an arc, which improves the distribution of the mechanical stresses and increases the mechanical endurance of the system 22.

A first end, in the present case an upper end, of the connecting rods 60 and 62 is adapted to be pivotably mounted on the shaft 20, and more specifically on an arm of the crank 24, in the present case in an aperture formed in this arm of the crank 24.

This pivot link is formed by means of a rigid axis 64, which extends perpendicularly to the connecting rods 60 and 62, preferably by projecting in relation to the outer lateral faces of the connecting rods 60 and 62. The reference X64 denotes the axis of rotation associated with this pivot link. The axis X64 is parallel to the axis X56 in the present case. The rigid axis 64 is placed on said first end of the connecting rods 60 and 62.

According to some examples, the rigid axis 64 is permanently secured to the connecting rods 60 and 62. In other words, the rigid axis 64 remains motionless in relation to the connecting rods 60 and 62.

The connecting rods 60 and 62 forming the second pair of connecting rods 44 are kept at a distance from one another in the direction X64 so as to allow one end 66 of the trip hook 40 to pass between the connecting rods 60 and 62.

This end 66 forms a projecting hooking portion that cooperates with the opening pawl 26, for example by abutting against the opening pawl 26 in the closed position.

The connecting rods 50 and 52 are connected to the connecting rods 60 and 62 by means of a single axis of articulation 68 that forms a pivot link between the connecting rods 50 and 52 of the first pair 42 and the connecting rods 60 and 62 of the second pair 44. The reference X68 denotes a straight line providing the axis of rotation associated with this pivot link.

The axis of articulation 68 extends along this axis X68, which is called "direction X68" below to avoid any confusion with the axis of articulation 68.

According to some examples, the connecting rods 60 and 62 are arranged on either side of the connecting rods 50 and 52 and are in contact with the contacting rods 50 and 52 over a portion of their length. The connecting rod 50 is adjacent to the connecting rod 60 and the connecting rod 52 is adjacent to the connecting rod 62.

The pivot link formed by the axis of articulation 68 is formed on the other end of each of the connecting rods 50, 52, 60 and 62, that is to say formed on the second end of the connecting rods 50 and 52 and on the second end of the connecting rods 60 and 62. In practice, the second end of each connecting rod is situated opposite the first end of said connecting rod.

As illustrated by the figures, the connecting rods 60 and 62 are, at their second end, interconnected only by the axis 68. In other words, to maintain a constant spacing between the pairs of rods 40 and 42, it is not necessary to add a fixed axis connecting the second ends of the connecting rods 60 and 62.

Thus, in the examples illustrated, the pivot link formed by the axis of articulation 68 is situated on the lower end of the connecting rods 60 and 62 and on the upper end of the connecting rods 50 and 52. In these examples, the articulation is therefore formed essentially in the middle of the linking system 22.

As illustrated in FIG. 4, the axis of articulation 68 includes a body of elongate, preferably cylindrical, shape. The axis of articulation 68 in the present case has a rotational symmetry around the direction X68. Other shapes are possible, however.

In practice, the corresponding ends of the connecting rods 50, 52, 60 and 62 comprise a through-aperture allowing the passage of the body of the axis of articulation 68.

Preferably, each of the ends of the axis of articulation 68 includes a head 70 and 72 formed in one piece with the body of the axis of articulation 68.

In the example illustrated, the head 70 juts out from the side of the outer face of the connecting rod 60 and the head 72 juts out from the side of the outer face of the connecting rod 62.

Preferably but nonetheless optionally, the height of each head 70 and 72, denoted by "h", measured perpendicularly to the face of the connecting rod 60 or 62 from which the head juts out, is less than or equal to 5 mm, preferably between 2 mm and 3 mm.

Each head 70 and 72 includes an overwidth forming a retaining portion in order to prevent separation of the connecting rods 50 and 52 of the first pair 42 and the connecting rods 60 and 62 of the second pair from one another, that is to say separation in the direction X68.

In other words, each head 70, 72 is wider than the body of the axis of articulation 68.

For example, if the axis of articulation 68 is cylindrical, the diameter of each head 70, 72 is greater than the diameter of the body of the axis of articulation 68, for example at least 1.1 times greater than the diameter of the body of the axis of articulation 68.

The axis of articulation 68 allows a constant separation to be kept between the connecting rods 50 and 52 and also between the connecting rods 60 and 62 even while the linking system 22 is moving.

As an illustrative example, the resistance to the lateral wrenching of a connecting rod in the direction X68 in relation to the other connecting rods at the axis of articulation 68, expressed by the minimum force necessary for such wrenching, is greater than or equal to 800 daN.

According to some examples, the greatest width of the head 70, 72, in the present case measured perpendicularly to the direction X68, is between 9 mm and 10 mm, preferably between 9.6 mm and 9.8 mm.

For example, the radius R1 is between 4.5 mm and 5 mm and the radius R2 is between 3 mm and 5 mm.

For example, each head 70 and 72 has a conical shape, the base of which, in contact with the body of the axis of articulation 68, has a radius R2 strictly less than the radius R1 measured at the top of the head 70, 72.

Other shapes are nevertheless possible, for example a cylindrical shape of constant diameter, which is nevertheless greater than the diameter of the body of the axis 68, however.

Preferably, the heads 70 and 72 are identical.

According to some examples, each of the connecting rods 50 and 52 is mounted on a first area of the axis of articulation 68 having a first diameter D1 and each of the connecting rods 60 and 62 is mounted on a second area of the axis of articulation 68 having a second diameter D2, which is different from the first diameter D1. For example, the diameter D1 is greater than the diameter D2. Thus, the body of the axis of articulation 68 in the present case includes at least two areas of diameter D1 and at least two areas of diameter D2. For example, the diameter D1 is equal to 9.5 mm and the diameter D2 is equal to 9 mm.

These areas of different dimensions form receiving areas of the connecting rods that prevent the connecting rods from sliding along the axis of articulation 68 in the course of the movement of the linking system 22. For example, the widening of the diameter between the second area and the first area prevents the connecting rods 60 and 62 from sliding towards the centre of the axis of articulation 68. This assists the stability of the linking system 22 and increases the resistance to wrenching.

The axis of articulation 68 can preferably turn freely around the direction X68 in relation to the connecting rods 50, 52, 60 and 62.

For example, the axis of articulation 68 is mounted in the linking system 22 so as to have a radial play of less than or equal to 0.1 mm and greater than 0 mm with the connecting rods 50, 52, 60 and 62.

The radial play is measured perpendicularly to the direction X68 in the present case.

In particular, the radial play is chosen in each of the receiving areas on the basis of the diameter of the through-aperture of the corresponding connecting rod 50, 52, 60 and 62. For example, the connecting rods of one and the same pair of connecting rods 42, 44 have such a through-aperture having one and the same diameter.

In many embodiments, the axis of articulation 68 is formed by a one-piece part.

According to some examples, the axis of articulation 68 is made of metal. Preferably, the axis of articulation 68 is made of a steel alloy, and more preferably of a steel alloy with chromium and molybdenum. Preferably, this steel alloy has previously undergone heat treatment in the mass to obtain a hardness of between 340 and 400 on the Vickers scale HV30.

Thus, the mechanical behaviour of the axis of articulation 68 is improved, which increases the endurance of the linking system 22 and reduces the risk of premature breakage, while providing the axis of articulation 68 with sufficient rigidity so as not to bring about unexpected deformations among the pairs of connecting rods 42, 44.

Optionally but nevertheless advantageously, the axis of articulation 68 includes a peripheral groove 74 formed at the base of each head 70 and 72, preferably arranged concentrically with the direction X68 and formed level with the face of the connecting rod 60, 62 from which the head 70 or 72 juts out.

The groove 74 makes it easier to obtain axial play in the direction X68 between the axis of articulation 68 and the connecting rods 50, 52, 60 and 62 with a desired value.

For example, the depth of the groove 74, measured perpendicularly to the direction X68, is between 0.2 mm and 0.6 mm and, preferably, equal to 0.4 mm.

Owing to the embodiments of the invention, the reliability of the switching mechanism 10 is increased, in particular owing to better durability of the linking system 22. In particular, owing to the use of the axis of articulation 68, the risk of accidental breakage of the pivot link between the connecting rods 50, 52, 60 and 62 is reduced, while permitting a pivot movement by the pair of connecting rods 42 in relation to the pair of connecting rods 44 that is necessary for the operation of the mechanism 10.

In particular, the axis of articulation 68 combines at once the function of providing the pivot link and the keeping of the separation between the pairs of connecting rods 42, 44.

On the other hand, the use of the axis of articulation 68 allows the linking system 22 to have a shape that makes it compatible with existing switching mechanisms, enabling it to be used in many ranges of electrical switching devices without needing to completely modify the architecture of the switching mechanisms of these devices.

The better mechanical behaviour thus allows a higher level of endurance to be obtained for the mechanism 10. The device 2 is therefore capable of withstanding a greater number of mechanical opening and closing cycles over its life.

The device 2 can thus advantageously be used in critical applications requiring a high level of reliability, in which it is likely to be called upon frequently, for example data centres or renewable energy production systems.

The embodiments and variants envisaged above can be combined to produce new embodiments.

The invention claimed is:

1. A device for switching an electric current, comprising:

separable fixed and mobile electrical contacts, and a mechanism configured to switch the contacts between a closed state and an open state, the mechanism including:

a switching shaft that is coupled to a mobile electrical contact;

a trip hook that is pivotably mounted on a fixed support of the mechanism; and a linking system coupling the switching shaft to the trip hook; wherein the linking system includes a first pair of connecting rods and a second pair of connecting rods, the first connecting rods being pivotably mounted on the trip hook, the second connecting rods being mounted so as to pivot with a crank of the switching shaft, the first connecting rods are connected to the second connecting rods with a single axis of articulation which forms a pivot link between the first connecting rods and the second connecting rods, each of the first connecting rods is mounted on a first area of the axis of articulation having a first diameter, and each of the second connecting rods is mounted on a second area of the axis of articulation having a second diameter, which is different from the first diameter.

2. The device according to claim 1, wherein the axis of articulation is mounted in the linking system so as to have a radial play of less than or equal to 0.1 mm for the first connecting rods and the second connecting rods.

3. The device according to claim 1, wherein the axis of articulation is made of a steel alloy with chromium and molybdenum.

4. The device according to claim 1, wherein the axis of articulation is formed by a one-piece part.

5. The device according to claim 1, wherein each of the second connecting rods has a shape bent in an arc.

6. The device according to claim 1, wherein each of the ends of the axis of articulation includes a head, each head including an overwidth funning a retaining portion for preventing separation of the first connecting rods and the second connecting rods from one another.

7. The device according to claim 6, wherein a height of each head is less than or equal to 5 mm.

8. The device according to claim 6, wherein the greatest width of each head is between 9 mm and 10 mm.

9. The device according to claim 6, wherein a height of each head is between 2 mm and 3 mm.

10. The device according to claim 6, wherein the greatest width of each head is between 9.6 mm and 9.8 mm.

11. The device according to claim 6, wherein the axis of articulation includes a peripheral groove formed at a base of each head.

12. The device according to claim 11, wherein a depth of the peripheral groove is between 0.2 mm and 0.6 mm.

13. The device according to claim 11, wherein a depth of the peripheral groove is equal to 0.4 mm.

* * * * *